US006638472B2

(12) United States Patent
Lemke

(10) Patent No.: US 6,638,472 B2
(45) Date of Patent: Oct. 28, 2003

(54) FURNACE ROLLER

(75) Inventor: Jürgen Lemke, Malliss (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/963,073

(22) Filed: Sep. 24, 2001

(65) Prior Publication Data

US 2002/0079624 A1 Jun. 27, 2002

(30) Foreign Application Priority Data

Sep. 22, 2000 (DE) ..... 100 47 046

(51) Int. Cl.[7] ..... C21B 3/00
(52) U.S. Cl. ..... 266/277; 432/236
(58) Field of Search ..... 266/176, 274, 266/276, 277; 432/236, 246

(56) References Cited

U.S. PATENT DOCUMENTS 1,889,527 A 11/1932 Barber
3,454,313 A 7/1969 Lohneis
4,299,018 A 11/1981 Bickerstaff et al.
5,421,724 A * 6/1995 Facco ..... 432/236
6,432,030 B1 * 8/2002 Miller ..... 432/236
6,435,867 B1 * 8/2002 Carr et al. ..... 432/236

FOREIGN PATENT DOCUMENTS

EP 0444312 9/1999

OTHER PUBLICATIONS

The Condensed Chemical Dictionary, 8th edition, p627, 8–1973.*

* cited by examiner

*Primary Examiner*—Scott Kastler
(74) *Attorney, Agent, or Firm*—Sidley Austin Brown & Wood, LLP

(57) ABSTRACT

A furnace roller for transporting of a continuously cast stock of a continuously casting plant through a temperature equalizing and heating furnace and including a rotatable arbor supported outside of the furnace and having cooling medium channels provided in its interior, a plurality of tires supported on the arbor and forming a transporting plane for the transported stock, at least one clamping ring provided between a tire and the arbor and formed of metal or alloy having a maximum possible thermal conductivity and susceptible to both cold and hot deformation, and at least one steel sleeve provided sidewise of the clamping ring.

9 Claims, 2 Drawing Sheets

FURNACE ROLLER

BACKGROUND OF INVENTION

1. Field of the Invention

Figure 1:
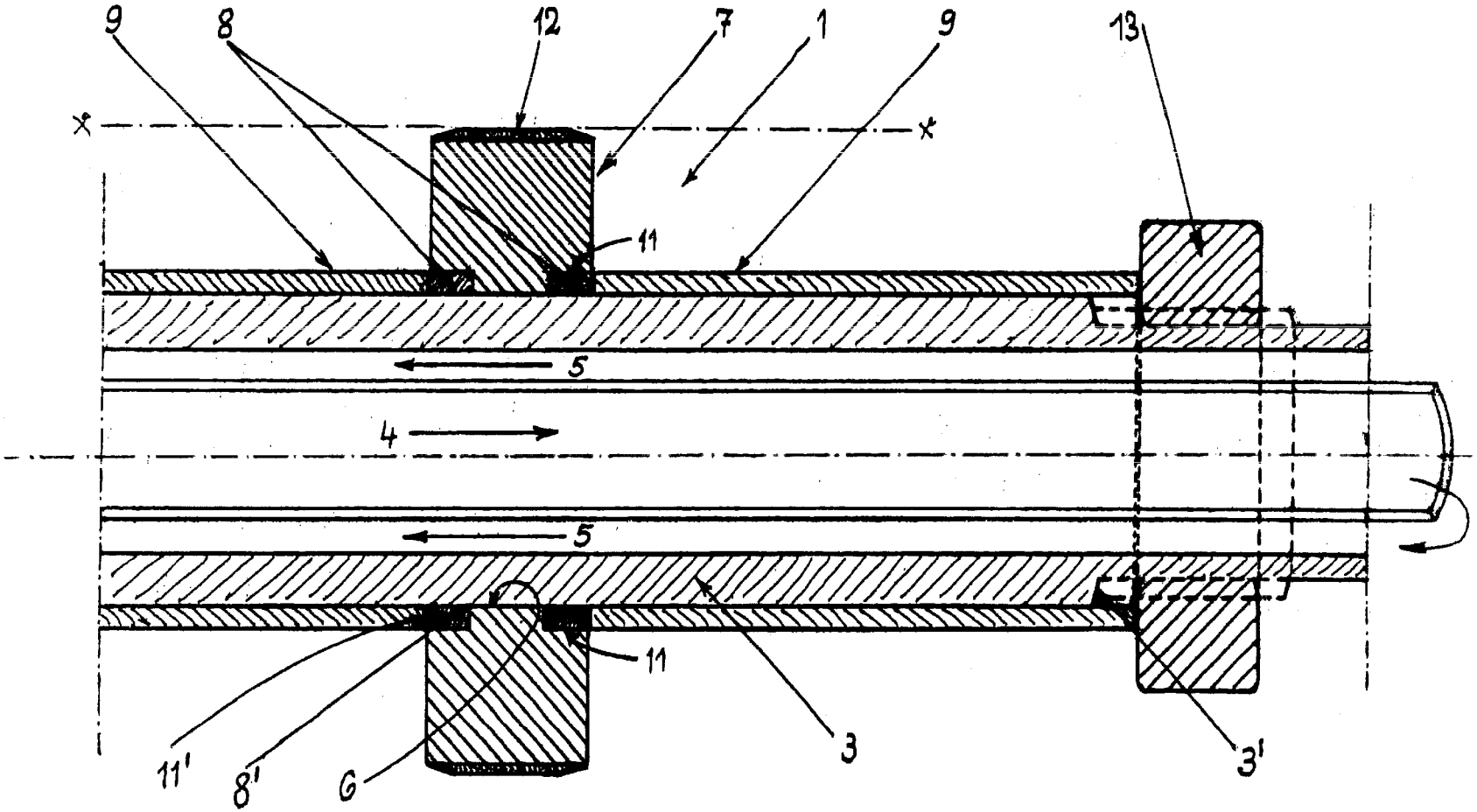

The present invention relates to a furnace roller for transporting of a continuously cast stock of a continuously casting plant through a temperature equalizing and heating furnace and including a rotatable arbor supported outside of the furnace and having cooling medium channels provided in its interior, and a plurality of fires supported on the arbor and forming a transporting plane for the transported stock.

2. Description of the Prior Art

In furnaces, in particular, in roller hearth furnaces of continuously casting plants, slabs are preheated to a rolling temperature. The conveying or transporting of the rolling stock or slabs through the roller hearth furnace is effected with furnace rollers of different shapes. The roller heath furnace is usually arranged between a casting machine and a rolling train and serves as a heating, equalizing, and buffer area. The conventional furnace rollers have different service life dependent of a kind of loading they are subjected during operation of a furnace.

The dimensions of hearth furnaces and their heating means, e.g., burners, are so selected that slabs exiting the furnace have a required rolling temperature. Uniform distribution of the temperature over the slab length, width and height is a necessary prerequisite for the following rolling. The length of a furnace defines a number of slabs, which can pass through the furnace after they have been cut off or separated from a cast strang.

The transportation of slabs is effected inside tile furnace with the driven furnace rollers. The furnace rollers are arranged at a predetermined height of the furnace at the level of the transportation plane of the slabs at a predetermined distance from each other. The dimensions of the furnace rollers are so selected that the diameter of the tires and arbors are smaller than the roller length.

The transporting furnace rollers of the roller hearth furnaces can be cooled with water or non-cooled, so-called dry rollers can be used.

A conventional water-cooled furnace roller has a plurality of tires arranged in a spaced relationship to each other on a water-cooled arbor. The tires are insulated from each other with a fireproof material, with the thickness of the insulation layer being equal to the outer diameter of the tires.

The arbor is supported outside of the furnace and is provided, outside of the furnace, with connections that provide for cooling of the arbor. The arbor is formed as a tubular member and is cooled from within. The internal cooling is effected with an inner circular pipe arranged in the arbor concentrically therewith. The cooling water flows through the pipe up to the opposite side of the furnace and there flows into annular clearance between the pipe and the arbor and flows back to the entry side, exiting there. In the clearance between the arbor and the pipe, there may be provided different constructional elements for fixing the pipe radially and for increasing the flow velocity of the water in the clearance.

The tires, which are supported on the arbor, are usually formed of a cast material such as a high-temperature nickel- or cobalt-based alloy. The arbor is usually formed of a high-temperature steel.

The water-cooled rollers are arranged primarily but not exclusively in the heating zone of the roller hearth furnace.

In the transporting direction, the rollers, which are arranged one after another, have a different alternating number of fires. Usually, the roller arbor is provided with four or five tires. The rollers with four and five tires have a different arrangement of rollers on the arbors. In four-tire rollers, two tires are provided on each of the arbor halves. In five-tire rollers, one tire is arranged in the middle of the roller, with a pair of tires provided on each half. However, in the five-tire rollers, the tires of a respective pair are offset outwardly in comparison with the arrangement of a pair of rollers in the four-tires rollers.

In conventional furnace rollers, the tires are secured on the arbor against an axial displacement by welding. The torque from the arbor to the tires is transmitted via arbor-tire hub connections, e.g., feather keys, or via the welding seams.

The tires become locked on the arbor as a result of expansion of tire material by heating during operation of the furnace. The alternating binding forces, which act on the furnace roller, and a high removal of heat from the tire surface to the cooling water inside the arbor lead to thermal stresses, in the heating phase, in the welding seams, which can result, with time, in their destruction, which would require replacement of the roller.

A major cause of a roller failure is the damage or destruction of the roller insulation, resulting from the fact the welding seams are subject to high furnace temperatures.

The transmission of heat from the tire to the water-cooled arbor, as a result of a contact between the tire and the arbor, leads to a noticeable reduction of the surface temperature of the tire. The reduction of the temperature of the tire surface depends on the, amount of heat transmitted therefrom to the cooling water. The colder is the tire surface the smaller is the tendency to the grow of scale.

During the production, e.g., of slabs, the hot steel comes into contact with the atmospheric oxygen. The steel surface oxidized, with formation of scale. The scale accumulation takes place where the gases surrounding the displaceable steel contain oxygen.

During transportation or conveying of slabs through the furnace, the scale falls off the slab surface and is removed through the scale gates provided in the bottom of the roller hearth furnace. On the other hand, upon the contact of the slab with the furnace roller in the furnace, the scale can be retained on the tire surface and accumulate there. This scale can be pressed into the bottom of the next transported slab, resulting, dependent on the thickness of the to-be-rolled slab, in a surface defect of the rolled slab. The surface defects result in excessive waste, and present a serious quality problem for the plant operator.

European Publication EP 0 633 815B1 discloses a furnace roller for supporting a heatable workpiece and having a rotatable arbor with inner cooling. The roller has a plurality of tires arranged on the arbor in a spaced relationship to each other. Heat-resistant insulation means, which surrounds the arbor, is provided between the tires. The insulation means has an outer surface that extends radially over at least a considerable portion of a radius of a tire pair. The insulation means is secured to the arbor by anchoring means, with the projecting ends of the anchoring means being located radially inwardly of the outer surface of the insulation means. There are provided metal spacer means which provide a stress relief for the castable insulation means from the thermal expansion of the anchoring means, which provides for excursion of the furnace roller.

German Patent DE 38 07 240 C1 discloses a roller hearth furnace for heating, slabs, blocks, billets, sheets, and similar goods and the furnace chamber of which has a longitudinally extending roller table. The furnace has a hot upper furnace zone, a bottom zone and a hearth bottom with recesses therebetween. The roller table is arranged in the bottom zone beneath the hearth bottom, and only small sections of the roller table rollers project through the recesses in the hearth bottom above its level. At least the running surfaces of the roller sections, which protrude into the heating zone and are used for transporting or conveying of the cast stock, are formed of a particularly heat-resistant material and are formed of separate segments forming a ring surrounding the roller circumference. There are further provided rinsing devices which prevent scale accumulation on the running surfaces of the rollers.

An object of the present invention is to provide a furnace roller wit an improved heat transmission between the tires and the arbor which would increase heat transfer from the tires to the arbor and, thereby, the service life of the tires due to a reduced accumulation of scale thereon.

Another object of the present invention is to provide a furnace roller with an improved torque transmission between the arbor and the tires.

A further object of the present invention is to provide a furnace roller which would permit to reduce expenditure of labor for mounting the tires on the arbor and would provide for a greater flexibility during mounting of the tires on the arbor.

SUMMARY OF THE INVENTION

These and other objects of the present invention, which will be come apparent hereinafter, are achieved by providing a furnace roller of the type described above and further including at least one clamping ring provided between a tire and the arbor and formed of a metal or an alloy having a maximum possible thermal conductivity and susceptible to both cold and hot deformations and at least one steel sleeve provided sidewise of the clamping ring and which undergoes upon heating, a thermal elongation applying pressure to the at least one clamping ring, plastically deforming the same, with contact surfaces of the clamping ring completely abutting associated surfaces of the tire and the arbor, providing for a good heat transmission between the components of the furnace roller and a reliable torque transmission between the arbor and the tire, The provision, according to the present invention, of a clamping ring formed of a material having a good thermal conductivity and flexibility permits to obtain an optimal metallic contact between the associated surfaces of the tire and the arbor. The obtained metallic contact insures a maximum possible heat transfer between the tires and the arbor and a reliable connection of the tires with the arbor. The obtained connection is comparable with mounting of the tires on the arbor with an interference fit, providing for a maximum torsion stability.

According to a further development of the present invention, the clamping ring is formed of a copped-based alloy, a copper-silver alloy, or of a metal having yield strength and heat conductivity substantially equal to those of a copper alloy.

According to a further development of the present invention, the clamping ring is formed of a copper-based alloy, a copper-silver alloy, or of a metal having yield strength and heat conductivity comparable with those of a copper alloy.

The foregoing modification further increases the contact area between the tires and the arbor, improving the heat transfer therebetween as well as the torque transmission therebetween.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION THE DRAWINGS

Figure 3:
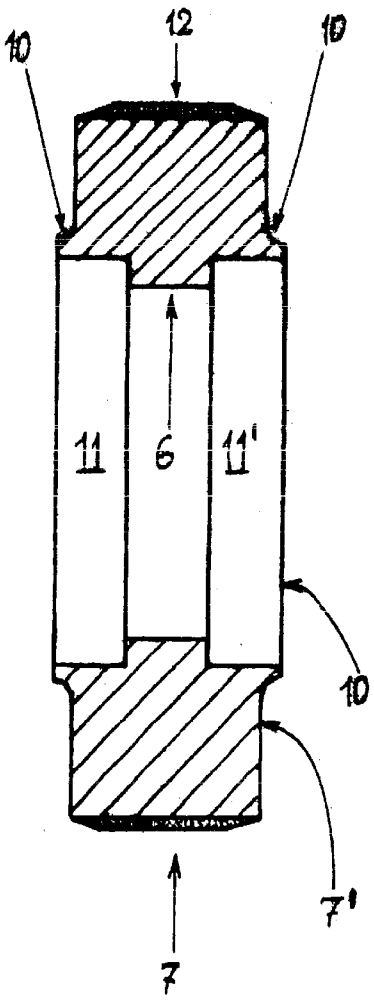
Figure 2:
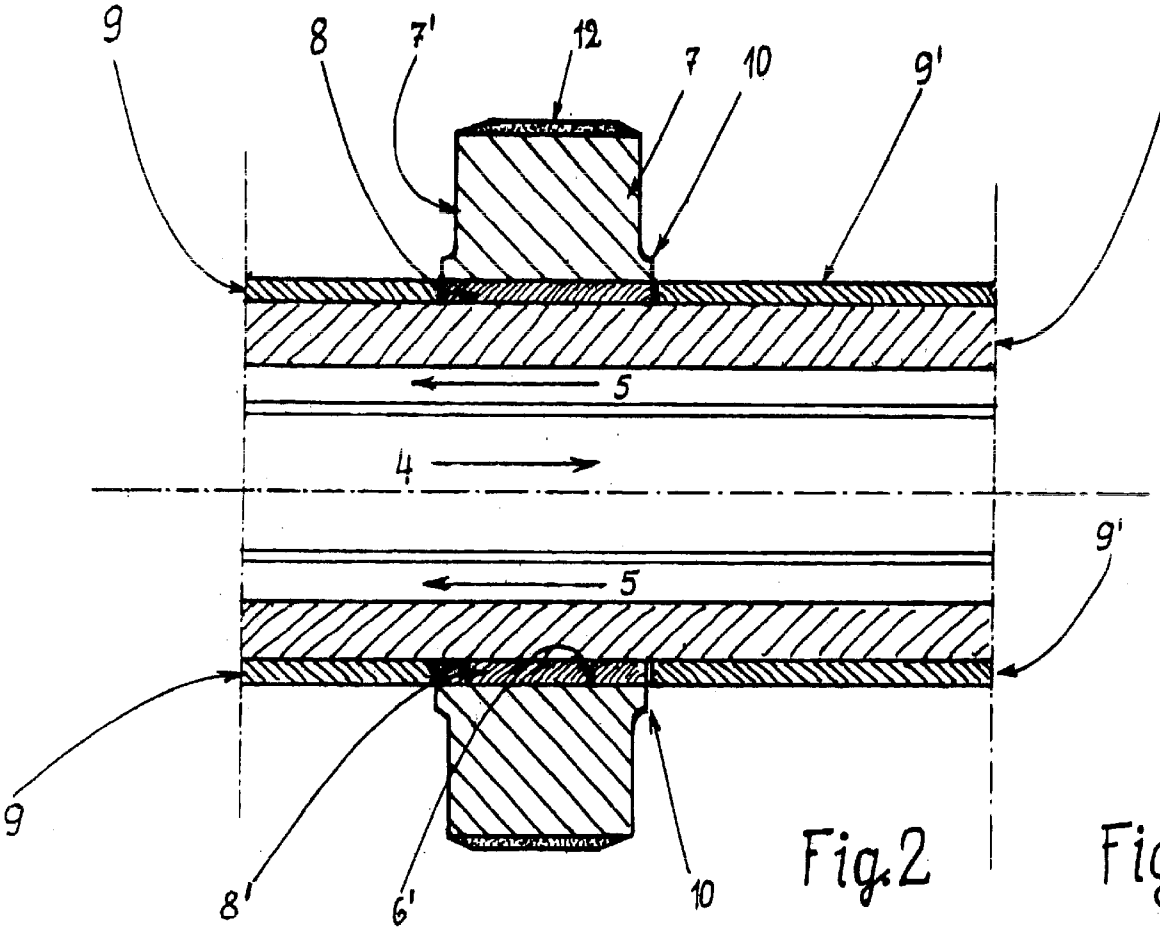

The drawings show:

FIG. 1 a cross-sectional view of an end section of a furnace roller according to the present invention, FIG. 2 a cross-sectional view of a section of a furnace roller according to the present invention with a different tire, and FIG. 3 an axial cross-sectional view of a tire for a furnace roller according to the present invention.

DETAILED DESCRIPTION OF THE PREFERRED EMBODIMENTS

A cooled furnace roller 1 for transporting of a continuously cast stock of a continuously casting plant through a temperature equalizing and heating furnace, an end portion of which is shown in FIG. 1, has a rotatable arbor 3, which is located outside of the furnace. Inside the arbor 3, there provided channels 4 and 5 through which a cooling medium can flow. A plurality of tires 7 are supported on the arbor 3 which extends through bores 6 formed in the tires 7. The tires 7 support the continuously cast stock transported in a transporting or conveying plane x—x. The tire 7 is formed as a circular disc and has, advantageously, its transporting peripheral surface covered with hard metal armour 12. The tire 7 is secured on the arbor 3 with clamping rings 8,8' received in recesses 11,11' formed in the tire 7. The clamping rings 8,8' are formed of copper or other alloys having as high as possible thermal conductivity and which can be subjected to both cold and hot deformation. Sidewise of the clamping rings 8,8', there are provided steel sleeves 9,9' which are pushed onto the arbor 7 and in a cold condition are pushed with a comparatively small axial pressure against the clamping rings 8,8' by an end tensioning nut 13.

Upon heating, e.g., by several hundred ° C., the sleeves 9,9' undergo a thermal elongation, applying an extremely high pressure to the clamping rings 8,8'. Under the pressure action, the clamping rings 8,8' become elastically deformed, whereby a firm contact between metallic surfaces of the clamping rings 8,8' and the arbor 3 is established. This insures a very good conductivity between all of the components of the furnace roller 1 and provides for a reliable torque transmission between the arbor 3 and the tires 7.

FIG. 2 shows an embodiment of a furnace roller according to the present invention in which the tire 7 has a hub 10 having an increased, in comparison with rim 7', width. The modified tire 7 has, as it can be seen in FIG. 3, circular recesses 11,11' for receiving the clamping rings 8,8'. However, instead of the circular recesses 11,11', the tire 7 can be provided with a singular axial bore 6' for receiving, e.g., the clamping ring with a snug fit.

In accordance with a further embodiment of a furnace roller according to the present invention, in order to prevent formation of an oxide layer, which hinders heat transmission, the contact surfaces of the clamping rings and of the bore are covered, in particular, with a nickel layer.

An end of the end section of the arbor 3 is provided with a thread 3' on which the tensioning nut 13 is screwed on.

Though the present invention was shown and described with references to the preferred embodiments, such are merely illustrative of the present invention and are not be construed as a limitation thereof, and various modifications of the present invention will be apparent to those skilled in the art. It is., therefore, not intended that the present invention be limited to the disclosed embodiments or details thereof, and the present invention includes all variations and/or alternative embodiments within the spit and scope of the present invention as defined by the appended claims.

What is claimed is:

1. A furnace roller for transporting of a continuously cast stock of a continuously casting plant through a temperature equalizing and heating furnace, comprising a rotatable arbor supported outside of the furnace and having cooling medium channel means provided in an interior thereof; a plurality of tires supported on the arbor and forming a transporting plane for the transported stock; at least one clamping ring provided between a tire and the arbor and formed of one of metal and alloy having a high thermal conductivity and susceptible to both cold and hot deformation; and at least one steel sleeve provided sidewise of the clamping ring, the steel sleeve undergoing, upon heating, a thermal elongation applying pressure to the at least one clamping ring, plastically deforming same, whereby contact surfaces of the clamping ring completely abut associated surfaces of the tire and the arbor providing for a good heat transmission between components of the furnace roller and a reliable torque transmission between the arbor and the tire.

2. A furnace roller as set forth in claim 1, wherein the at least one clamping ring is formed of a copper-based plastic alloy.

3. A furnace roller as set forth in claim 1, wherein the at least one clamping ring is formed of one of copper, copper-based alloy, and copper-silver alloy.

4. A furnace roller as set forth in claim 1, wherein the at least one clamping ring is formed of a metal material having yield strength and heat conductance substantially equal to those of a copper alloy.

5. A furnace roller as set forth in claim 1, wherein the tire has a hub a width of which is greater than a width of a rim thereof and which is provided, on opposite sides thereof, with circular recesses for receiving each a clamping ring.

6. A furnace roller as set forth in claim 1, wherein the fire has a hub provided with an axial bore for receiving the at least one clamping ring.

7. A furnace roller as set forth in claim 1, wherein the contact surfaces of the at least one clamping ring are covered with a nickel layer.

8. A furnace roller as set forth in claim 1, wherein an arbor end is provided with a thread, and wherein the furnace roller further comprises a tensioning nut screwed on the threaded end for retaining the at least one sleeve in engagement with the at least one clamping ring.

9. A furnace roller as set forth in claim 1 wherein transporting plane-forming peripheral surfaces of the tire are covered with a hard metal armour.

* * * * *